11/17/81 XR 4,301,236

United States Patent [19]
Idota et al.
[11] 4,301,236
[45] Nov. 17, 1981

[54] PHOTOGRAPHIC BLEACH SOLUTIONS

[75] Inventors: Yoshio Idota; Minoru Yamada, both of Minami-ashigara, Japan

[73] Assignee: Fuji Photo Film Co., Ltd., Kanagawa, Japan

[21] Appl. No.: 114,456

[22] Filed: Jan. 23, 1980

[30] Foreign Application Priority Data

Jan. 23, 1979 [JP] Japan ..... 54-6645

[51] Int. Cl.³ ..... G03C 5/32
[52] U.S. Cl. ..... 430/393; 430/430; 430/461; 430/943; 252/95; 252/99; 252/102
[58] Field of Search ..... 430/393, 430, 461, 943; 252/102, 95, 99

[56] References Cited

U.S. PATENT DOCUMENTS

| | | | |
|---|---|---|---|
| 3,532,634 | 10/1970 | Woods | 252/95 |
| 3,820,997 | 6/1974 | Shirasu et al. | 430/393 |
| 3,870,520 | 3/1975 | Shimamura et al. | 430/393 |
| 4,119,557 | 10/1978 | Postlethwaite | 252/95 |
| 4,203,765 | 5/1980 | Claeys et al. | 430/430 |

*Primary Examiner*—J. Travis Brown
*Attorney, Agent, or Firm*—Sughrue, Mion, Zinn, Macpeak & Seas

[57] ABSTRACT

A bleach solution for color photographic materials having a high bleaching activity and capable of providing color images having good quality containing hydrogen peroxide or a compound releasing hydrogen peroxide, an organic metal complex salt, and an unsubstituted or substituted aromatic sulfonic acid or a salt thereof.

23 Claims, No Drawings

PHOTOGRAPHIC BLEACH SOLUTIONS

BACKGROUND OF THE INVENTION

1. Field of the Invention

This invention relates to a photographic processing for silver halide color photographic materials and, more particularly, to a photographic bleach solution for silver halide color photographic materials having a sufficient bleaching activity and capable of forming color images having good quality.

2. Description of the Prior Art

In photographic processing for silver halide color photographic materials, a color photographic material (the silver halide photographic emulsions thereof may have been fogged beforehand) is developed in an ordinary manner, after being imagewise exposed using a developer containing an aromatic primary amine color developing agent in the presence of dye forming couplers to provide color images and developed silver formed simultaneously with the formation of the color images is re-halogenated by bleaching and is removed by fixing (or blixing) together with undeveloped silver halides.

Hitherto, a ferricyanide, ferric chloride, aminopolycarboxylic acid ferric complex salt, etc., have mainly been used as a bleaching agent. A ferrycyanide and ferric chloride are good bleaching agents in the points that they have a sufficiently high bleaching speed (oxidizing speed) and developed silver is sufficiently oxidized in a definite period of time. However, since a bleach solution using a ferricyanide as bleaching agent liberates a cyan ion by photodecomposition to cause environmental pollution, a treatment must be applied to make the waste bleach solution completely nontoxic. Also, a bleach solution using ferric chloride as bleaching agent has a fault that parts of a processor containing the bleach solution are liable to be corroded owing to the very low pH and very large oxidative power as well as has a fault that in the wash step after bleach processing, iron hydroxide deposits in silver halide emulsion layers to cause so-called stains. Consequently, a cleaning step by an organic chelating agent must be applied after bleaching, which conflicts with the purposes to process quickly and save labour, and also the use of such a bleach solution is undesirable in terms of environmental problems since there is a danger of generating a hydrogen chloride gas.

On the other hand, a metal complex of an organic acid such as a metal complex salt of aminopolycarboxylic acid gives less environmetal pollution as compared with a ferricyanide or ferric chloride and hence such a complex salt has frequently been used recently as bleaching agent. However, an organic metal complex as bleaching agent has generally a relatively low oxidative power and is also insufficient in bleaching power, when a bleaching solution using the complex salt as bleaching agent is used for bleaching, for example, a desired object may be attained to some extent using low speed silver halide color photographic materials mainly composed of silver chlorobromide emulsions, but when the bleach solution is used for bleaching high speed silver halide color photographic materials which are mainly composed of silver iodochlorobromide emulsions or silver iodobromide emulsions and have been color-sensitized, (in particular silver halide color photographic materials using high silver content silver halide emulsions) the removal of silver becomes poor due to the insufficient bleaching action and so-called poor recoloring occurs (i.e., the dyes formed by the oxidative coupling of the oxidation product of a color developing agent and couplers remain as leuco dyes which are reaction intermediates). The term "high silver content silver halide emulsions" as used herein refers to silver halide emulsions having no more than 30–40 mg/100 $cm^2$ of the total silver amount in blue-sensitive, green-sensitive and red-sensitive silver halide emulsion layers. Thus, to rapid processing high speed silver halide color photographic materials it is necessary to overcome these difficulties.

As a process for overcoming the difficulties, it is proposed in Japanese patent application (OPI) No. 109731/75 (The term "OPI" as used herein refers to a "published unexamined Japanese patent application".) to use an iron or cobalt complex salt of an organic acid together with hydrogen peroxide. In general, in the case of using such a bleach solution, leuco compounds are effectively converted into dyes immediately after the preparation of the bleach solution but is has a fatal fault that when the bleach solution is allowed to stand after the preparation thereof, the oxidative power thereof rapidly decreases and the oxidation of silver and the oxidation of leuco compounds become insufficient. This fault exists even in a range of acidic side (pH 2–6) at which the bleach solution is said to be relatively stable. This is considered to be caused by the acceleration of the decomposition of hydrogen peroxide by metal ions.

Furthermore, the use of hydrogen peroxide is accompanied by a fault that the layers of photographic materials are broken during processing. Also, a metal such as stainless steel, etc., is used for automatic processors and in case of using such a bleach solution, there is a fault that hydrogen peroxide contained in the bleach solution causes self-decomposition by the catalytic action of the metal to reduce the bleaching power of the bleach solution.

Moreover, even in the case of aminopolycarboxylic acid iron complexes, when the complexes are used in large quantities, the concentration of iron ions increases, which is undesirable for environmental reasons.

On the other hand, since hydrogen peroxide forms water by the decomposition, it is an ideal oxidizing agent which causes no environmental pollution. Therefore, it has long been desired in this field of art to use practically a bleach solution for color photographic materials using hydrogen peroxide.

However, hydrogen peroxide is a strong oxidizing agent but when hydrogen peroxide is simply used as a bleaching agent, it is impossible to practically use hydrogen peroxide for bleaching silver in color photographic materials.

SUMMARY OF THE INVENTION

A first object of this invention is, therefore, to provide an effective bleach solution for silver halide color photographic materials containing hydrogen peroxide as the main bleaching component.

A second object of this invention is to provide a bleach solution of silver halide color photographic materials causing no environmental pollution, having excellent storage stability, and showing a high bleaching speed.

A third object of this invention is to provide a processing process for silver halide color photographic materials without so-called poor recoloring phenomenon that the dyes formed by oxidative coupling remain in the state of leuco dyes after bleach step.

A fourth object of this invention is to provide a process for processing silver halide color photographic materials which always maintains a stable bleaching power.

The objects of this invention can be attained by a bleach solution comprising hydrogen peroxide (or a compound releasing hydrogen peroxide or a mixture of hydrogen peroxide and a compound releasing hydrogen peroxide), an organic acid metal complex salt, and at least one substituted or unsubstituted aromatic sulfonic acids (including salts thereof and the acid may have two or more sulfon groups).

DESCRIPTION OF THE INVENTION

The organic acid metal complex salts used in this invention are compounds having the ability to convert metallic silver formed by development into silver halide by oxidizing it and simultaneously converting leuco dyes into dyes, and they have a structure formed by chelating an aminopolycarboxylic acid, an organic phosphonic acid, or polycarboxylic acid such as citric acid, oxalic acid, etc., with a high valent metal ion such as iron (III) ion, cobalt(III) ion, copper(II) ion, etc. Chelating agents used for forming the complex salts used in this invention are the polycarboxylic acids represented by following formula I:

$$R_1(COOH)_l \qquad \text{(I)}$$

wherein $R_1$ represents a single bond, an unsubstituted or substituted alkylene group having 1 to 6 carbon atoms wherein the substituent is a hydroxy group and/or a carboxy group, a $-(CH_2)_m-O-(CH_2)_n-$ group wherein m and n are integers and m+n is 2 to 6, a $-(CH_2)_{m'}-S-(CH_2)_{n'}-$ group wherein m' and n' are integers and m'+n' is 2 to 6, or an alkenylene group having 2 to 6 carbon atoms; l represents an integer of 2 to 3; and when $R_1$ is a single bond, l is 2.

Typical examples of the polycarboxylic acid represented by the formula (I) are as follows:

Citric acid,
Oxalic acid,
Malonic acid
Tartaric acid,
Diglycollic acid, and
Thiodiglycollic acid.

Chelating agents used for forming the complex salts used in this invention are the aminopolycarboxylic acids represented by following formula II:

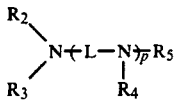

(II)

wherein $R_2$, $R_3$, $R_4$ and $R_5$ each represents a carboxyalkyl group wherein the alkyl moiety has 1 to 2 carbon atoms, a hydroxyalkyl group having 1 to 2 carbon atoms and/or a hydrogen atom; p represents zero or an integer of 1 to 3; L represents an alkylene group having 2 to 4 carbon atoms, a $-(CH_2)_x[O-(CH_2)_y]_z$ group wherein x is an integer of 2 to 4, y is an integer of 2 to 4 and z is an integer of 1 to 3, a 6-membered cyclic alkylene group, or an arylene group (e.g., phenylene); and the aminopolycarboxylic acid of the formula (II) has at least 1 carboxy group.

Typical examples of the aminopolycarboxylic acids of the formula (II) or the salts thereof are as follows:

Ethylenediaminetetraacetic acid,
Ethylenediaminetetraacetic acid disodium salt,
Ethylenediaminetetraacetic acid diammonium salt,
Ethylenediaminetetraacetic tetra(trimethylammonium) salt,
Ethylenediaminetetraacetic acid tetrapotassium salt,
Ethylenediaminetetraacetic acid tetrasodium salt,
Ethylenediaminetetraacetic acid trisodium salt,
Diethylenetriaminepentaacetic acid,
Diethylenetriaminepentaacetic acid pentasodium salt,
Ethylenediamine-N-(β-oxyethyl)-N,N',N'-triacetic acid,
Ethylenediamine-N-(β-oxyethyl)-N,N',N'-triacetic acid sodium salt,
Ethylenediamine-N-(β-oxyethyl)-N,N',N'-triacetic acid triammonium salt,
Propylenediaminetetraacetic acid,
Propylenediaminetetraacetic acid sodium salt,
Nitrilotriacetic acid,
Nitrilotriacetic acid sodium salt,
Cyclohexanediaminetetraacetic acid,
Cyclohexanediaminetetraacetic acid sodium salt,
Iminodiacetic acid,
Dihydroxyethylglycine,
Ethyl ether diaminetetraacetic acid,
Glycol ether diaminetetraacetic acid,
Ethylenediaminetetrapropionic acid, and
Phenylenediaminetetraacetic acid.

Chelating agents used for forming the complex salts used in this invention are the organic phosphonic acids represented by following formulae III-a or III-b:

$$R_6(PO_3H_2)_q \qquad \text{(III-a)}$$

$$R_6(LPO_3H_2)_q \qquad \text{(III-b)}$$

wherein $R_6$ represents a substituted or unsubstituted alkyl or alkylene group having 1 to 4 carbon atoms wherein the substituent is a hydroxy group and/or a carboxy group, or a substituted or unsubstituted diaminoalkylene group having 2 to 16carbon atoms wherein the substituent is a hydroxy group; L represents an alkylene group having 1 to 2 carbon atoms; and q represents an integer of 1 to 5.

Typical examples of the organic phosphonic acids of the formulae III-a and III-b are as follows:

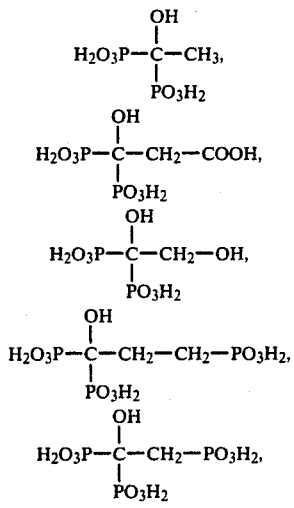

-continued

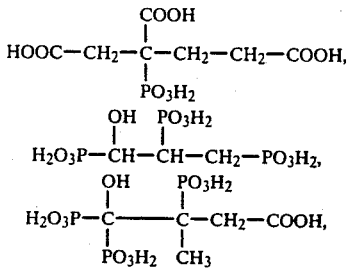

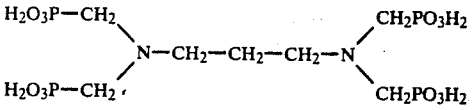

and

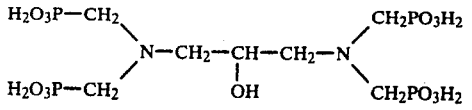

Although the invention is not limited to the compounds thus illustrated above.

Preferred examples of the chelating agent are an ethylenediaminetetraacetic acid and a salt thereof and an ethylenediamine-N-(β-oxyethyl)-N,N'-N'-triacetic acid and a salt thereof.

As the metal ions, ferric ions are preferred and in this case, the proportion of the ferric ions is 0.0001 to 2 moles, preferably 0.01 to 0.2 mole per liter of bleach solution.

As compounds releasing hydrogen peroxide used in this invention, perboric acid (or salts thereof), and percarbonic acid (or salts thereof) are preferred. Urea-hydrogen peroxide compound and peracetic acid are also useful. The proportion of hydrogen peroxide or the compound releasing hydrogen peroxide is about 0.1 to 10 moles, preferably 0.1 to 2 moles per liter of bleach solution. In this invention, a preferred effect is achieved if the mole number of hydrogen peroxide (or percursor) per liter of the bleach solution is larger than that of the ferric ion and further it is more preferred that the mole number of the hydrogen peroxide is twice as large as the ferric ion.

The substituted or unsubstituted aromatic sulfonic acids (or salts thereof) or substituted or unsubstituted aromatic polyvalent sulfonic acids (or salts thereof) used in this invention can be represented by following formula IV:

$$Q-(SO_3M)_r \qquad (IV)$$

wherein M represents a hydrogen atom, an alkali metal atom (e.g., sodium or potassium), or an ammonium group; r represents an integer of 1 to 5; and Q represents an aromatic hydrocarbon group or an aromatic heterocyclic group including at least one nitrogen atom or sulfur atom. These aromatic groups may have one or more substituents. Examples of the substituents are aliphatic groups or aromatic hydrocarbon groups (each of which may be substituted by, e.g., a carboxyl group, a hydroxy group, an amino group, a nitro group, a nitroso group, or a halogen atom), a carboxy group, a hydroxy group, an amino group, a nitro group, a nitroso group, and a halogen atom.

Practical examples of the compounds represented by general formula IV are illustrated below:

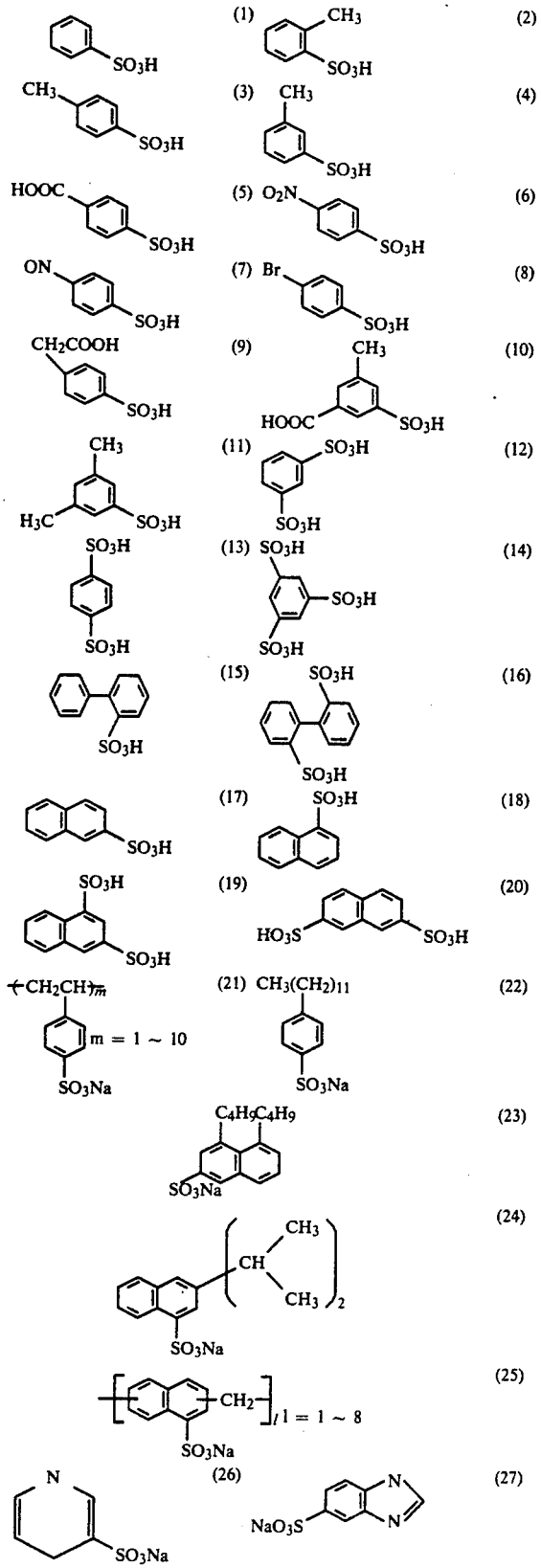

A proper addition amount of the compound shown by general formula IV is about $5\times10^{-5}$ to 0.3 mole, prefrably about $10^{-3}$ to 0. 1mole per liter of bleach solution. In the case of polymer, it means a mole number of sulfon groups.

This invention is distinguished from conventional techniques by the following reasons.

Hydrogen peroxide itself has very low rate for oxidizing silver but when a very small amount of a ferric ion which oxidizes silver very slowly is added to hydrogen peroxide, the rate of bleaching silver by the system becomes very high. Thus, it is expected that hydrogen peroxide is decomposed by the catalytic action of the iron ions to generate an oxidative power (this is well known decomposition reaction of a Fenton reagent). On the other hand, Japanese patent application (OPI) No. 102296/78 discloses that a condensation product of naphthalenesulfonic acid and formalin controls the decomposition of hydrogen peroxide in the presence of iron ions. Therefore, in spite of the expectation that the addition of a compound having a sulfon group will be accompanied by a side-action, i.e., a reduction in bleaching rate, on the contrary, the bleaching rate is not reduced by the addition of a compound having a sulfon group and further the reduction in oxidative power during storage as occurs in the above-described coexisting system of ferric ions and hydrogen peroxide can be prevented, and hence the invention provides an effect which is unusual by comparison to the conventional techniques.

In this invention, a ferric ion exists at the abovedescribed concentration and the existence of the ion has the effect of increasing the storage stability of the bleach solution containing hydrogen peroxide as the main component.

Furthermore, the bleach solution of this invention has the following effect. That is, it is known that hydrogen peroxide causes self-decomposition by the catalytic action of a metal such as stainless steel but the bleach solution of this invention can restrain the self-decomposition of hydrogen peroxide and hence stainless steel, titanium alloys, etc., can be used for automatic precessors in this invention.

The bleach solutions used in this invention may further contain various additives together with the abovedescribed compounds.

Preferred additives used in this invention for accelerating bleaching are halides such as alkali halides and ammonium halides, for example, potassium bromide, sodium bromide, ammonium bromide, sodium chloride, etc. The addition amount of the additive is about 0.01 to 5 moles, preferably about 0.2 to 2 moles per liter of the bleach solution.

Furthermore, it is preferred to add an aliphatic carboxylic acid, an aliphatic phosphonic acid, or an aliphatic phosphonocarboxyli acid, such as, for example, acetic acid, acetates, propionic acid, propionates, succinic acid, succinates, malonic acid, malonates, citric acid, citrates, 2,2-diphosphonoethanol or the salts thereof, and 2-phosphono-1,2,4-tricarboxylic acid or the salts thereof The addition amount of it is about 0.01 to 5 moles, preferably about 0.1 to 1 mole per liter of the bleach solution.

Also, additives which are conventionally used in bleach solutions, for example, a pH buffer such as a borate, an acetate, a phosphate, etc.; a pH adjusting agent such as sodium hydroxide, ammonia water, etc.; a corrosion inhibitor such as ammonium nitrate, etc.; a swelling preventing agent such as ammonium sulfate, a surface active agent (e.g., polyethylene oxide, etc.), etc., can be properly added.

The pH of the bleach solution used in this invention is about 1 to 10, preferably about 3 to 8. The bleaching temperature is typically from 20° to 60° C.

Furthermore, in the case of processing silver halide color photographic materials using the bleach solution of this invention, a substituted alkylthiol compound or a precursor may be used as a bleach accelerator in a bath used prior to the bleach bath. Typical examples of the substituted alkylthiol compounds or the precursors thereof are described in U.S. Pat. No. 3,893,858; *Research Disclosure*, 15704 (1977, May); and Japanese patent application (OPI) Nos. 20832/77; 32736/78; 94927/78; 95630/78 and 95631/78.

The substituted alkylthiol compounds or the precursors thereof which may be used in this invention are shown by the general formula:

$$R-S-Y$$

wherein R represnts an alkyl group having 1 to 10 carbon atoms, which may have one or more substituents and may be branched; at least one of the substituents for group R being a hydroxy group, a primary, a secondary, a tertiary amino group, a carboxy group, a sulfon group, a piperidino group, a pyrrolyl group, a morpholino group, an imidazole group, or a benzotriazole group; and Y represents a hydrogen atom or an amidino group.

Practical examples of these compounds are as follows:

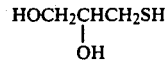
(31)

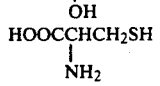
(32)

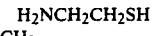
(33)

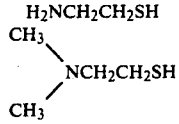
(34)

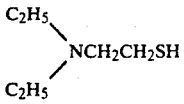
(35)

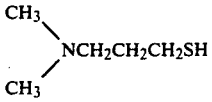
(36)

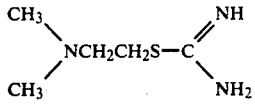
(37)

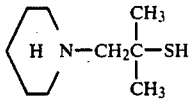
(38)

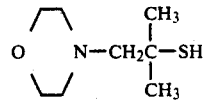
(39)

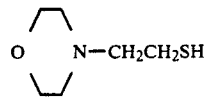
(40)

-continued (41)

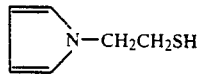

(42)

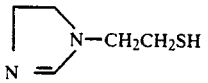

(43)

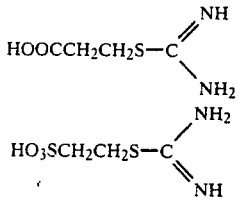

(44)

(45) $HOCH_2CH_2SH$

(46) $HOCH_2CH_2CH_2SH$ (47)

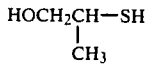

(48)

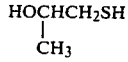

(49)

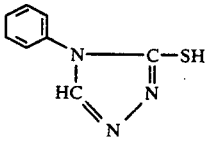

(50)

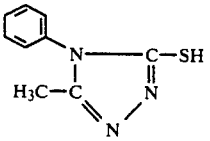

These compounds may form salts such as chlorides. Also, the above-described compounds are typical examples and the invention is not limited to these compounds. The addition amount of this additive is about $1\times10^{-5}$ to 1 mole/liter, preferably about $1\times10^{-3}$ to $1\times10^{-1}$ mole/liter.

The processing baths containing these compounds include a processing bath used after the color development bath and prior to the bleach bath. For example, there is a stop bath, and a stop-fix bath.

When color photographic materials are processed using a bath containing the substituted alkylthiol compound or a precursor thereof prior to performing the bleach processing using the bleach solution of this invention, the bleaching period can be greatly shortened.

The bleach solution of this invention used can be easily reproduced for reuse by adding hydrogen peroxide thereto.

This invention can be applied to the processing of whole color photographic materials using silver halide emulsions, such as color papers, color negative films, color reversal films, color positive films, etc., but when the bleach solution of this invention is used for processing color photographic materials using high silver content silver halide emulsions having a total silver content in silver halide emulsion layers of 30 mg/100 $cm^2$ or more, the effect of this invention is large and when the invention is used for the processing of color photographic materials having a total silver amount of 40 mg or more per 100 $cm^2$, the invention is particularly useful.

In this invention, processings for imagewise exposed color negative films, color positive films, color papers, etc., are fundamentally composed of the following steps:

(1) color development→stop →bleach→wash→fix→wash→stabilization→dry, (2) color development→stop→bleach→fix→wash→stabilization→dry, (3) color development→stop-fix→bleach→fix→wash→stabilization→dry, or (4) color development→bleach→wash→fix→wash→stabilization→dry.

In processings (1) to (4), a pre-bath, a hardening bath, etc., may be employed before the color development and also a stabilization or a wash after bleach may be omitted.

On the other hand, processings for color reversal films are fundamentally composed of the following steps:

(5) black and white development→stop→wash→fogging→wash→color development→stop→wash→bleach→wash→fix→wash→stabilization→dry or (6) black and white development→stop→wash→fogging→wash→color development→stop→wash→bleach→fix→wash→stabilization→dry.

In processings (5) and (6), a pre-bath, a pre-hardening bath, a neutralization bath, etc., may be employed. Also, a stabilization or a wash after bleach may be omitted. Furthermore, the fogging bath may be replaced with reexposure and also by adding a fogging agent to the color developer, the fogging bath may be omitted.

In the photographic processing of this invention, the above-described steps (1) to (6) are useful but the invention is not limited to these steps.

The color developer used in this invention has a composition for ordinary color developer containing an aromatic primary amine developing agent and preferred examples of the aromatic primary amine color developing agent are such p-phenylenediamine derivatives as N,N-diethyl-p-phenylenediamine, 2-amino-5-diethylaminotoluene, 2-amino-5-(N-ethyl-N-laurylamino)-toluene, 4-[N-ethyl-N-(β-hydroxyethyl)amino]aniline, 2-methyl-4-[N-ethyl-N-(β-hydroxyethyl)-amino]aniline, N-ethyl-N-(β-methanesulfonamidoethyl)-3-methyl-4-aminoaniline described in U.S. Pat. No. 2,193,015, N-(2-amino-5-diethylaminophenylethyl)methanesulfonamide and N,N-dimethyl-p-phenylenediamine described in U.S. Pat. No. 2,592,364, 4-amino-3-methyl-N-ethyl-N-methoxyethylaniline, 4-amino-3-methyl-N-ethyl-N-β-ethoxy-ethylaniline, 4-amino-3-methyl-N-ethyl-N-β-butoxyethylaniline, and the salts thereof (e.g., sulfates, hydrochlorides, sulfites, p-toluenesulfonates, etc.), etc., described in U.S. Pat. Nos. 3,656,950; 3,698,525; etc.

The color developer may further contain other known components used in ordinary color developers. For example, sodium hydroxide, potassium hydroxide, sodium carbonate, potassium carbonate, sodium or potassium tertiary phosphate, potassium metaborate, borax, etc., may be used solely or as a combination thereof as an alkalifying agent or a buffer. Also, various salts such as di-sodium or di-potassium hydrogenphosphate, potassium or sodium dihydrogenphosphate, sodium or potassium hydrogencarbonate, boric acid, an alkali nitrate, an alkali sulfate, etc., can be also used together with the above-described additive for giving buffer action, for the convenience of preparing color developers, or for increasing the ionic strength.

The color developer may contain, if necessary, a development accelerator. For example, there are various pyridinium compounds and other cationic compounds described in U.S. Pat. No. 2,648,604; Japanese Patent Publication 9503/69 and U.S. Pat. No. 3,671,247; cationic dyes such as phenosafranine; neutral salts such as thallium nitrate and potassium nitrate; nonionic compounds such as polythioethers, polyethylene glycol and the derivatives thereof described in Japanese patent publication No. 9504/69; and U.S. Pat. Nos. 2,533,990; 2,531,832; 2,950,970 and 2,577,127; the organic solvents and organic amines (e.g., ethanolamine, ethylenediamine, diethanolamine, etc.) described in Japanese patent publication 9509/69 and Belgian Patent 682,862 as well as the accelerators described in L. F. A. Mason, *Photographic Processing Chemistry,* pages 40–43 (Focal Press-London-1966). Also, benzyl alcohol and phenyl ethyl alcohol described in U.S. Pat. No. 2,515,147 and pyridine, ammonia, hydrazine, and amines described in *Journal of the Society of Photographic Science and Technology of Japan;* Vol. 14, pages 74 (1952) are also useful development accelerators.

Also, sulfites such as, for example, sodium sulfite, potassium sulfite, potassium hydrogensulfite, and sodium hydrogensulfite as well as hydroxylamine, ascorbic acid, pentose, hexose, etc., usually used as preservatives in photographic field may be added to the color developers used in this invention.

Still further, the color developers used in this invention may further contain, if necessary, any desired antifoggant. As the antifoggants used in this invention, there are alkali metal halides such as potassium bromide, sodium bromide, potassium iodide, etc., and organic antifoggants. Examples of organic antifoggants are nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, etc.; mercapto-substituted heterocyclic compounds such as 1-phenyl-5-mercaptotetrazole, 2-mercaptobenzimidazole, 2-mercaptobenzothiazole, etc.; and mercapto-substituted aromatic compounds such as thiosalycilic acid, etc. Preferred examples of organic antifoggants are nitrogen-containing heterocyclic compounds, in particular nitrogen-containing heterocyclic compounds which have not been substituted by mercapto group. The proportion of the antifoggant is about 1 mg to 5 g, preferably 5 mg to 1 g per liter of the color developer.

Furthermore polyphosphoric acid compounds exemplified by sodium hexametaphosphate, sodium tetrapolyphosphate, sodium tripolyphosphate, potassium hexametaphosphate, potassium tetrapolyphosphate, potassium tripolyphosphate, etc.; or aminopolycarboxylic acids exemplified by phosphonocarboxylic acid, α-aminoacid, ethylenediaminetetraacetic acid, nitrilotriacetic acid, cyclohexanediaminetetraacetic acid, iminodiacetic acid, N-hydroxymethylethylenediaminetriacetic acid, diethylenetriaminepentaacetic acid, etc., may be used as a water softener for the color developers. The addition amount of the material depends upon the hardness of water to be used but is usually about 0.5 to 1 g/liter.

Moreover, calcium or magnesium covering agents can be used in the photographic processing solutions in this invention. They are described in detail in, for example, J. Williams, *Belgische Chemische Industrie,* Vol. 21, page 325 (1956) and *ibid.,* Vol. 23, page 1105 (1958).

In the case of reversal color processing, competing couplers, fogging agents, and compensation developing agents may be used.

As the competing couplers, there are citrazinic acid, J-acid, H-acid, etc. Practical examples of these competing couplers used in this invention are described in U.S. Pat. No. 2,742,832; Japanese patent publications 9504/69; 9506/69 and 9507/69 and U.S. Pat. Nos. 3,520,690; 3,560,212;; 3,645,737; etc.

As the fogging agents used in this invention, there are alkali metal borohydrides (e.g., sodium borohydride), amineboranes (e.g., t-butylamineborane), tin-aminopolycarboxylic acid complex salts, tin-pyrophosphoric acid complex salts, tin-tetrapolyphosphoric acid complex salts, tin-hexametaphosphoric acid complex salts, ethylenediamine, etc. Also, the compounds described in Japanese patent publication 38816/72 are useful for the fogging agent.

As the compensation developing agents used in this invention, there are p-aminophenyl, N-benzyl-p-aminophenol, 1-phenyl-3-pyrazolidone, etc. Other examples of the compensation developing agent used advantageously in this invention are described in, for example, Japanese patent publications Nos. 41475/70 and 19037/71.

The pH of the color developer used in this invention is about 7 to 14, preferably about 8 to 13.

The processing process of this invention can be applied not only to a color photographic system wherein dye forming couplers are incorporated in color photographic materials as described in, for example, U.S. Pat. Nos. 2,322,027; 2,376,679 and 2,801,171 but also to a color photographic system wherein couplers are incorporated in color developers as described in, for example, U.S. Pat. Nos. 2,252,718; 2,590,970 and 2,592,243.

At present, however, the former system is mainly performed. In the case that dye forming couplers are incorporated in color photographic materials, multilayer color photographic materials are generally used and in this case it is preferred that the couplers remain in definite emulsion layers and do not diffuse into other emulsion layers during the production steps thereof, preservation, and processing steps for them.

A fix solution having a composition usually used for the purpose can be used in this invention. As a fixing agent, there are thiosulfates, thiocyanates, thioureas, thioglycols, water-soluble organic diols containing sulfur or oxygen in the molecule (e.g., 3,6-dithia-1,8-octyldiol), etc. The fixing solution may further contain a stabilizer such as a sulfite (e.g., sodium sulfite), etc., and a pH buffering salt or a swelling inhibiting salt (e.g., a hardening agent such as potassium alum) and when a thiosulfate is used as the fixing agent, the use of the aforesaid stabilizer is particularly preferred.

Moreover, the black and white developer used in a silver dye bleaching process or a reversal color photographic process in this invention may contain a developing agent generally used in black and white developers. As the developing agent, a dihydroxybenzene (e.g., hydroquinone, sodium hydroquinonemonosulfonate, etc.), a 3-pyrazolidone (e.g., 1-phenyl-3-pyrazolidone, etc.), an aminophenol (e.g., N-methyl-p-aminophenol, etc.), ascorbic acid, etc., may be used solely or as a combination thereof. The developer may further contain a preservative, an alkalifying agent, a pH buffer, an antifoggant, etc., and also, if necessary, it may further contain a dissolution aid, a toning agent, a development accelerator, a surface active agent, a defoaming agent, a water softener, a hardening agent, a tackifier, etc., well-known about the detail of them in the field of the art.

The photographic silver halide emulsion layers of the color photographic materials used in this invention may contain color image-forming couplers, that is, the compounds forming dyes by the reaction with the oxidation product of an aromatic amine (usually primary amine) developing agent (hereinafter, referred to as simply couplers). The couplers are preferably non-diffusible ones having a hydrophobic group called as a ballast group in the molecule. The couplers may be 4-equivalent ones or two-equivalent ones for silver ion. Also, the silver halide emulsion layers may further contain colored couplers having an effect of color correction or couplers releasing a development inhibitor with the progress of development (i.e., so-called DIR couplers). Still further, the couplers may be couplers providing colorless products by the coupling reaction thereof.

As a yellow coupling coupler, known open chain ketomethylene couplers can be used. In particular, benzoylacetanilide series compounds and pivaloylacetanilide series compounds are advantageously used in this invention. Practical examples of the yellow coupling couplers are described in U.S. Pat. Nos. 2,875,057; 3,265,506; 3,408,194; 3,551,155; 3,582,322; 3,725,072; and 3,891,445; West German patent No. 1,547,868; West German patent publications (OLS) Nos. 2,219,917; 2,261,361 and 2,414,006; U.K. Pat. No. 1,425,020; Japanese patent publication No. 10783/76; and Japanese patent applications (OPI) Nos. 26133/72; 73147/73; 102636/76; 6341/75; 123342/75; 130442/75; 21827/76; 87650/75; 82424/77 and 115219/77.

As the magenta coupling couplers used in this invention, there are pyrazolone series compounds, indazolone series compounds, and cyanoacetyl series compounds but in particular, pyrazolone series compounds are more useful. Practical examples of the magenta coupling couplers are described in U.S. Pat. Nos. 2,600,788; 2,983,608; 3,062,653; 3,127,269; 3,311,476; 3,419,391; 3,519;429; 3,558,319; 3,582,322; 3,615,506; 3,834,908; and 3,891,445; West German Pat. No. 1,810,464; West German patent application (OLS) Nos. 2,408,665; 2,417,945; 2,418,959 and 2,424,467; Japanese patent publication Nos. 6031/65 and 45990/76; and Japanese patent application (OPI) Nos. 20826/76; 58922/77; 129538/74; 74027/74; 159336/75; 42121/77; 74028/74; 60233/75; 26541/76 and 55122/78.

As the cyan coupling couplers used in this invention, there are phenol series compounds, naphthol series compounds, etc. Practical examples of them are described in U.S. Pat. Nos. 2,369,929; 2,434,272; 2,474,293; 2,521,908; 2,895,826; 3,034,892; 3,311,476; 3,458,315; 3,476,563; 3,583,971; 3,591,383; 3,767,411 and 4,004,929; West German patent application (OLS) Nos. 2,414,830 and 2,454,329; and Japanese patent application (OPI) Nos. 59838/73; 26034/76; 5055/73; 146828/76; 69624/77 and 90932/77.

Examples of the colored couplers used in this invention are described in, for example, U.S. Pat. Nos. 3,476,560; 2,521,908 and 3,034,892; Japanese patent Publication Nos. 2016/69; 22335/63; 11304/67 and 32461/69; Japanese patent application (OPI) Nos. 26034/76 and 42121/77 and West German patent application (OLS) No. 2,418,959.

Also, examples of the DIR couplers used in this invention are described in, for example, U.S. Pat. Nos. 3,227,554; 3,617,291; 3,701,783; 3,790,384 and 3,632,345; West German patent application (OLS) Nos. 2,414,006; 2,454,301 and 2,454,329; U. K. Pat. Nos. 953,454; Japanese patent application (OPI) Nos. 69624/77; 122335/74 and 69624/77 and Japanese patent publication No. 16141/76.

The color photographic materials used in this invention may further contain compounds releasing a development inhibitor at development and examples of these compounds are described in, for example, U.S. Pat. Nos. 3,297,445 and 3,379,529; West German patent application (OLS) No. 2,417,914; and Japanese patent application (OPI) Nos. 15271/77 and 9116/78.

The couplers described above may be incorporated as a combination of two or more couplers in the same silver halide emulsion layer of a color photographic material or the same coupler may be incorporated in two or more silver halide emulsion layers of a color photographic material.

These couplers are dispersed in silver halide photographic emulsions together with a solvent having a proper polarity. Useful solvents for the purpose are tri-o-cresyl phosphate, trihexyl phosphate, dioctylbutyl phthalate, dibutyl phthalate, diethyllaurylamide, 2,4-diallyl phenol, octyl benzoate, etc.

Typical examples of the color image forming materials used in the color photographic materials for silver dye bleach process processed according to this invention are, for example, azo dyes.

The color photographic material processed according to this invention has at least one silver halide emulsion layer on a support and usually has a red sensitive silver halide emulsion layer, a green sensitive silver halide emulsion layer and a blue sensitive silver halide emulsion layer on a support. More practically, the color photographic material used in this invention has usually at least a red sensitive silver halide emulsion layer containing a cyan image forming coupler, at least a green sensitive silver halide emulsion layer containing a magenta image forming coupler, and at least a blue sensitive silver halide emulsion layer containing a yellow image forming coupler. Such a color photographic element may further include non-photosensitive photographic layers (e.g., antihalation layer, interlayer for color mixing prevention, etc., yellow filter layer, protective layer, etc.). Also, there is no particular restriction about the order of the red sensitive emulsion layer, the green sensitive emulsion layer and the blue sensitive emulsion layer described above. The silver halide photographic emulsions used in this invention may be surface latent image type emulsions or inside latent image type emulsions which are prepared by known processes.

As described above in detail, there are no particular restrictions on the process for producing the silver halide emulsions of color photographic materials used in this invention, the layer structures of the color photographic materials, photographic additives, photographic elements, and photographic processing solutions.

By employing the bleach composition of this invention, the following advantages are obtained:

(1) Environmental pollution is reduced.
(2) Bleaching speed is high.
(3) Stains do not occur.
(4) So-called inferior recoloring in which dyes formed in a development step remain as leuco dyes even after the bleaching step does not occur.
(5) The reduction in bleaching faculty when the bleach solution is allowed to stand for a long period of time is less and hence the bleach solution can be stably stored for a long period of time.

(6) The bleach solution can be easily regenerated for reuse.

The invention will now be further explained in the following example.

EXAMPLE

A color reversal photographic material was prepared by coating a triacetate film successively with the following layers in order.

1st layer (red sensitive silver halide emulsion layer):

The coating composition for the emulsion layer was prepared by mixing a red sensitive silver iodobromide emulsion (silver iodide: 7 mole percent) and a cyan coupler emulsion (containing 1-hydroxy-4-chloro-2-n-dodecylnaphthamide as a cyan coupler and dibutyl phthalate as a coupler solvent) in such a manner that the silver/coupler mole ratio became 8.0. The coverage of silver was 1.5 g/m$^2$.

2nd layer (intermediate layer):

A gelatin intermediate layer containing di-t-amyl.hydroquinone dispersed therein.

3rd layer (green sensitive silver halide emulsion layer):

The coating composition for the emulsion layer was prepared by mixing a green sensitive silver iodobromide emulsion (silver iodide: 6 mole percent) and a magenta coupler emulsion (containing 1-(2,4,6-trichlorophenyl)-3-[3-(2,6-di-t-amylphenoxyacetamido)benzamido]-5-pyrzaolone as a magenta coupler and tricresyl phosphate as a coupler solvent) in such a manner that the silver/coupler mole ratio became 9.5. The coverage of silver: 1.5 g/m$^2$.

4th layer (yellow filter layer):

A filter layer composed of yellow colloid silver and gelatin.

5th layer (blue sensitive silver halide emulsion layer):

The coating composition for the emulsion layer was prepared by mixing a blue sensitive silver iodibromide emulsion (silver iodide: 6 mole percent) and a yellow coupler emulsion (containing α-pivaloyl-2-chloro-5-[γ-(2,4-di-t-amylphenoxy)butanamido]acetanilide as a yellow coupler and dibutyl phthalate as a coupler solvent) in such a manner that the silver/coupler mole ratio became 8.0. The coverage of silver: 1.8 g/m$^2$.

The 6th layer (protective layer):

A protective layer mainly composed of gelatin.

The color reversal photographic film was exposed through an optical wedge to a tungsten lamp as a light source for 1/100 sec., and thereafter subjected to the following reversal processings:

| Processing step | Temperature | Time |
|---|---|---|
| 1st Development (black and white) | 43° C. | 2 min. |
| Stop | 40° C. | 20 sec. |
| Wash | 40° C. | 40 sec. |
| Color Development | 46° C. | 2 min. |
| Stop | 40° C. | 20 sec. |
| Wash | 40° C. | 1 min. |
| Bleach | 40° C. | 1 min. 30 sec. |
| Fix | 40° C. | 40 sec. |
| Wash | 40° C. | 1 min. |
| Stabilization | 40° C. | 20 sec. |
| Dry | 37° C. | |

The compositions of the processing solutions used in the above processing steps were as follows:

| | |
|---|---|
| The 1st Developer: | |
| Sodium Sulfite | 60.0 g |
| 1-Phenyl-3-pyrazolidone | 0.3 g |
| Hydroquinone | 5.0 g |
| Sodium Carbonate (monohydrate) | 41.0 g |
| Potassium Bromide | 2.0 g |
| Potassium Iodide (1% aq. soln.) | 1.0 ml |
| Potassium Thiocyanate (1N aq. soln.) | 10.0 ml |
| Sodium hydroxide (10% aq. soln.) | 2.0 ml |
| Water to make | 1.0 liter. |
| Stop Solution: | |
| Sodium Acetate | 30 g |
| Glacial Acetic Acid | 8 ml |
| Water to make | 1 liter. |
| Color Developer: | |
| Benzyl Alcohol | 5.0 ml |
| Sodium Hydroxide | 0.5 g |
| Diethylene Glycol | 3.0 ml |
| Sodium Hexametaphosphate | 2.0 g |
| Sodium Sulfite | 2.0 g |
| Potassium Bromide | 2.0 g |
| Ethyl-N-(β-methanesulfonamido-ethyl)aniline sesquisulfate monohydrate | 9.0 g |
| Citrazinic Acid | 0.4 g |
| Metaboric Acid | 0.5 g |
| Sodium Metaborate tetrahydrate | 77.0 g |
| Sodium Borohydride | 0.1 g |
| Water to make | 1 liter. |
| Bleach Solution: | |
| Bleach Solution-1: | |
| Potassium Ferricyanide | 50 g |
| Potassium Bromide | 25 g |
| Sodium Primary Phosphate | 1 g |
| Water to make | 1 liter. |
| Fix Solution: | |
| Sodium Thiosulfate | 200 g |
| Sodium Sulfite | 15 g |
| Borax | 12 g |
| Glacial Acetic Acid | 15 ml |
| Water to make | 1 liter. |
| Stabilizing Solution: | |
| Formalin (37%) | 10 ml |
| Fuji Dry Well (trade name, made by Fuji Photo Film Co.) | 5 ml |
| Water to make | 1 liter. |

The same procedure as above was followed by changing the bleaching time and the composition for the bleach solution as follows:

Bleaching Time: 1 min., 2 min., 2 min. 30 sec., 3 min., 3 min. 30 sec., 5 min., 10 min., 20 min.

| Bleach Solution: | |
|---|---|
| Bleach Solution-2: | |
| Ethylenediaminetetraacetic Acid 2-sodium Salt | 0.5 g |
| Ethylenediaminetetraacetic Acid Ferric Ammonium Dihydrate | 10 g |
| Ammonium Bromide | 100 g |
| Acetic Acid | 20 ml |
| Aqueous ammonia and water to make | 1 liter |
| pH | 4.0 |
| Bleach Solution-3: | |
| Ammonium Bromide | 100 g |
| Acetic Acid | 20 ml |
| 30% Hydrogen Peroxide | 50 ml |
| Aqueous ammonia and water to make | 1 liter. |
| pH | 4.0 |
| Bleach Solution-4: | |
| Ethylenediaminetetraacetic Acid 2-sodium Salt | 0.5 g |
| Ethylenediaminetetraacetic Acid Ferric Ammonium Dihydrate | 10 g |
| Ammonium Bromide | 100 g |
| Acetic Acid | 20 ml |
| 30% Hydrogen Peroxide | 50 ml |
| Aqueous ammonia and water to make | 1 liter. |

-continued

| Bleach Solution: | |
|---|---|
| pH | 4.0 |

Bleach Solution-5:

To 1 liter of Bleach Solution-4 was added 2 g of the monohydrate of Compound (1) illustrated before and the pH of the solution was adjusted to 4.0.

Bleach Solution-6:

To 1 liter of Bleach Solution-4 was added 2 g of the di-sodium salt of Compound (12) and the pH of the solution was adjusted to 4.0.

Bleach Solution-7:

To 1 liter of Bleach Solution-4 was added 2 g of Compound (18) and the pH of the solution was adjusted to 4.0.

Bleach Solution-8:

To 1 liter of Bleach Solution-4 was added 2 g of Compound (21) and the pH of the solution was adjusted to 4.0.

Bleach Solution-9:

To 1 liter of Bleach Solution-4 was added 2 g of Compound (25) and the pH of the solution was adjusted to 4.0.

| Bleach Solution-10: | |
|---|---|
| Ethylenediaminetetraacetic Acid 2-sodium Salt | 0.5 g |
| Ethylenediaminetetraacetic Acid Ferric Ammonium Dihydrate | 4 g |
| Ammonium Bromide | 100 g |
| Acetic Acid | 20 ml |
| 30% Hydrogen Peroxide | 50 ml |
| Aqueous ammonia and water to make | 1 liter. |
| pH | 4.0 |

Bleach Solution-11:

To 1 liter of Bleach Solution-10 was added 2 g of Compound (25) and the pH was adjusted to 4.0.

The periods of time required for bleaching (the time when the total remained amount of silver in the color photographic film bleached became almost same as the total remaining amount of silver in the color photographic film bleached by Bleach Solution-1 (bleaching time: 1 min. 30 sec.) are shown in the following table as the photographic properties obtained by the processings using Bleach Solutions 2-11.

Furthermore, for determining the storage stability of a part of the bleach solutions, each of the bleach solutions was allowed to stand for 5 days at 20° C. or for 4 days at 40° C. and then the residual percentage of hydrogen peroxide in the bleach solution was measured, the results being also shown in the same table.

TABLE

| Bleach Solution | Time required to Finish Bleaching | Storage Stability (residual % of $H_2O_2$) 20° C. for 5 days | 40° C. for 4 days | Remarks |
|---|---|---|---|---|
| Solution-1 | 1 min. 30 sec. | — | — | Comparison |
| Solution-2 | 20 min. | — | — | Comparison |
| Solution-3 | scarcely bleached | 90% | 60% | Comparison |
| Solution-4 | 2 min. 30 sec. | 40% | 0.1% | Comparison |
| Solution-5 | 2 min. 30 sec. | 80% | — | Invention |
| Solution-6 | 2 min. 30 sec. | 70% | — | Invention |
| Solution-7 | 2 min. 30 sec. | 83% | 50% | Invention |
| Solution-8 | 2 min. 30 sec. | 80% | — | Invention |
| Solution-9 | 2 min. 30 sec. | 88% | 54% | Invention |
| Solution-10 | 3 min. | 55% | 0.3% | Comparison |
| Solution-11 | 3 min. | 90% | 60% | Invention |

From the results shown in the above table, it will be understood that the bleach solutions of this invention had excellent storage stability and the addition of the compound having a sulfon group did not give any influences on the time required for finishing the bleach and the bleach solutions of this invention showed high bleaching speed even by the addition of such a compound.

While the invention has been described in detail and with reference to specific embodiments thereof, it will be apparent to one skilled in the art that various changes and modifications can be made therein without departing from the spirit and scope thereof.

What is claimed is:

1. A bleach solution for silver halide color photographic materials comprising hydrogen peroxide and/or a compound releasing hydrogen peroxide, an organic metal complex salt which is a chelate of a polycarboxylic acid represented by formula (I), an aminopolycarboxylic acid represented by formula (II) or an organic phosphonic acid represented by formula (III-a) or (III-b) and a high valent metal ion, $$R_1(COOH)_l \qquad (I)$$

wherein $R_1$ represents a single bond, an unsubstituted or substituted alkylene group having 1 to 6 carbon atoms wherein the substituent is a hydroxy group and/or a carboxy group, a $-(CH_2)_m-O-(CH_2)_n-$ group wherein m and n are integers and m+n is 2 to 6, a $-(CH_2)_{m'}-S-(CH_2)_{n'}-$ group wherein m' and n' are integers and m'+n' is 2 to 6, or an alkenylene group having 2 to 6 carbon atoms; l represents an integer of 2 to 3; and when $R_1$ is a single bond, l is 2,

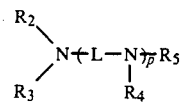

(II)

wherein $R_2$, $R_3$, $R_4$ and $R_5$ each represents a carboxyalkyl group wherein the alkyl moiety has 1 to 2 carbon atoms, a hydroxyalkyl group having 1 to 2 carbon atoms and/or a hydrogen atom; p represents zero or an integer of 1 to 3; L represents an alkylene group having 2 to 4 carbon atoms, a $-(CH_2)_x[O-(CH_2)_y]_z$ group wherein x is an integer of 2 to 4, y is an integer of 2 to 4 and z is an integer of 1 to 3, a 6-membered cyclic alkylene group, or an arylene group; and the aminopolycarboxylic acid of the formula (II) has at least 1 carboxy group, $$R_6(PO_3H_2)_q \qquad (III\text{-}a)$$

$$R_6(LPO_3H_2)_q \qquad (III\text{-}b)$$

wherein $R_6$ represents a substituted or unsubstituted alkyl or alkylene group having 1 to 4 carbon atoms wherein the substituent is a hydroxy group and/or a carboxy group, or a substituted or unsubstituted diaminoalkylene group having 2 to 16 carbon atoms wherein the substituent is a hydroxy group; L represents an alkylene group having 1 to 2 carbon atoms; and q represents an integer of 1 to 5, and at least one aromatic sulfonic acid or salt or salt thereof, said aromatic sulfonic acid or salt thereof being present in an concentration of $10^{-3}$ to 0.1 mole per liter of bleaching solution, said bleach solution having a pH of about 1 to 8.

2. The bleach solution of claim 1, wherein said high valent metal ion is of iron, cobalt, or copper.

3. The bleach solution of claim 1, wherein said metal ion is a ferric ion.

4. The bleach solution of claim 1, wherein hydrogen peroxide or a compound capable of releasing hydrogen peroxide is present in an amount of about 0.01 to 10 mols per liter of bleach solution.

5. The bleach solution of claim 1, wherein said aromatic sulfonic acid is represented by the formula (III)

$$Q-(SO_3M)_r \qquad \text{(III)}$$

wherein M represents a hydrogen atom, an alkali metal atom, or an ammonium group; r represents an integer of 1 to 5 and Q represents an aromatic hydrocarbon group or an aromatic heterocyclic group including at least one nitrogen atom or sulfur atom.

6. The bleach solution of claim 5, wherein said aromatic group may be substituted by one or more substituents selected from the group consisting of aliphatic and aromatic hydrocarbon groups, a carboxy group, a hydroxy group, an amino group, a nitro group, a nitroso group or a halogen atom.

7. The bleach solution of claim 1, which additionally comprises an alkali or an ammonium halide.

8. The bleach solution of claim 1, which additionally comprises an aliphatic carboxylic acid, an aliphatic sulfonic acid, or an aliphatic phosphonocarboxylic acid.

9. In a process for developing a color photographic material including a bleaching step, the improvement which comprises bleaching said material in a solution containing hydrogen peroxide and/or a compound capable of releasing hydrogen peroxide, an organic metal complex salt which is a chelate of an aminopolycarboxylic acid, an organic phosphonic acid, or a polybasic organic acid and a high valent metal ion, and at least one aromatic sulfonic acid or salt thereof, said aromatic sulfonic acid or salt thereof being present in a concentration of $10^{-3}$ to 0.1 mole per liter of bleaching solution.

10. The process of claim 9, wherein said high valent metal ion is of iron(III), cobalt(III), or copper(II).

11. The process of claim 9, wherein said chelating agent is represented by formula (I), (II), (III-a) or (III-b):

$$R_1(COOH)_l \qquad \text{(I)}$$

ps wherein $R_1$ represents a single bond, an unsubstituted or substituted alkylene group having 1 to 6 carbon atoms wherein the substituent is a hydroxy group and/or a carboxy group, a $-(CH_2)_m-O-(CH_2)_n-$ group wherein m and n are integers and m+n is 2 to 6, a $-(CH_2)_{m'}-S-(CH_2)_{n'}-$ group wherein m' and n' are integers and m'+n' is 2 to 6, or an alkenylene group having 2 to 6 carbon atoms; l represents an integer of 2 to 3; and when $R_1$ is a single bond, l is 2,

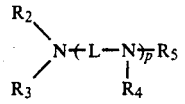

(II)

wherein $R_2$, $R_3$, $R_4$ and $R_5$ each represents a carboxyalkyl group wherein the alkyl moiety has 1 to 2 carbon atoms, a hydroxyalkyl group having 1 to 2 carbon atoms and/or a hydrogen atom; p represents zero or an integer of 1 to 3; L represents an alkylene group having 2 to 4 carbon atoms, a $-(CH_2)_x[O-(CH_2)_y]_z$ group wherein x is an integer of 2 to 4, y is an integer of 2 to 4 and z is an integer of 1 to 3, a 6 membered cyclic alkylene group, or an arylene group; and the aminopolycarboxylic acid of the formula (II) has at least 1 carboxy group, $$R_6(PO_3H_2)_q \qquad \text{(III-a)}$$

$$R_6(LPO_3H_2)_q \qquad \text{(III-b)}$$

wherein $R_6$ represents a substituted or unsubstituted alkyl or alkylene group having 1 to 4 carbon atoms wherein the substituent is a hydroxy group and/or a carboxy group, or a substituted or unsubstituted diaminoalkylene group having 2 to 16 carbon atoms wherein the substituent is a hydroxy group; L represents an alkylene group having 1 to 2 carbon atoms; and q represents an integer of 1 to 5.

12. The process of claim 9, wherein said metal ion is a ferric ion.

13. The process of claim 9, wherein hydrogen peroxide or a compound capable of releasing hydrogen peroxide is present in an amount of about 0.01 to 10 mols per liter of bleach solution.

14. The process of claim 9, wherein said aromatic sulfonic acid is represented by the formula (III):

$$Q-(SO_3M)_r \qquad \text{(III)}$$

wherein M represents a hydrogen atom, an alkali metal atom, or an ammonium group; r represents an integer of 1 to 5 and Q represents an aromatic hydrocarbon group or an aromatic heterocyclic group including at least one nitrogen atom or sulfur atom.

15. The process of claim 14, wherein said aromatic group may be substituted by one or more substituents selected from the group consisting of aliphatic and aromatic hydrocarbon groups, a carboxy group, a hydroxy group, an amino group, a nitro group, a nitroso group, or a halogen atom.

16. The process of claim 9 which additionally comprises an alkali or an ammonium halide.

17. The process of claim 9, which additionally comprises an aliphatic carboxylic acid, an aliphatic sulfonic acid, or an aliphatic phosphonocarboxylic acid.

18. The process of claim 9, wherein said composition provides a bleach solution having a pH of about 1 to 10.

19. The process of claim 9, wherein prior to bleaching with said solution, said photograph material is bleached with a solution containing a substituted alkylthiol compound or a precursor thereof.

20. The process of claim 19, wherein said alkylthiol compound is represented by the formula

R—S—Y wherein R represents an alkyl group containing 1 to 10 carbon atoms, which may be substituted with one or more substituents selected from the group consisting of a hydroxy group, a primary, a secondary, or a tertiary amino group, a carboxy group, a sulfon group, a piperidino group, a pyrrolyl group, a morpholino group, an imidazole group, and a benzotriazole group; and Y represents a hydrogen atom or an amidino group.

21. The process of claim 9, wherein said process is a direct color process.

22. The process of claim 9, wherein said process is a color reversal process.

23. The process of claim 18, wherein the pH is about 1 to 8.

* * * * *